US010746008B2

(12) United States Patent
Spoerker

(10) Patent No.: US 10,746,008 B2
(45) **Date of Patent: *Aug. 18, 2020**

(54) WEIGHT ON BIT CALCULATIONS WITH AUTOMATIC CALIBRATION

(71) Applicant: Saudi Arabian Oil Company, Dhahran (SA)

(72) Inventor: Hermann F. Spoerker, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 1017 days.

This patent is subject to a terminal disclaimer.

(21) Appl. No.: 14/951,002

(22) Filed: Nov. 24, 2015

(65) Prior Publication Data

US 2017/0145809 A1 May 25, 2017

(51) Int. Cl.

| | |
|---|---|
| ***E21B 44/00*** | (2006.01) |
| ***E21B 12/02*** | (2006.01) |
| ***E21B 47/007*** | (2012.01) |
| ***E21B 44/02*** | (2006.01) |
| ***E21B 19/08*** | (2006.01) |

(Continued)

(52) U.S. Cl.

CPC ..... *E21B 44/00* (2013.01); *E21B 10/00* (2013.01); *E21B 12/02* (2013.01); *E21B 19/08* (2013.01); *E21B 41/0092* (2013.01); *E21B 44/02* (2013.01); *E21B 47/007* (2020.05)

(58) Field of Classification Search

CPC ..... E21B 19/08; E21B 44/00; E21B 44/02; E21B 44/08

See application file for complete search history.

(56) References Cited

U.S. PATENT DOCUMENTS 4,549,431 A * 10/1985 Soeiinah ..... E21B 44/00 175/45
5,010,765 A 4/1991 Duckworth
5,654,503 A 8/1997 Rasmus (Continued)

FOREIGN PATENT DOCUMENTS

WO 2008/070829 A2 6/2008
WO WO2013/000094 A1 1/2013

(Continued)

OTHER PUBLICATIONS

International Search Report and Written Opinion for related PCT application PCT/US2016/063032 dated Jul. 12, 2017.
May 13, 2019 EP First Examination Report dated May 13, 2019.

*Primary Examiner* — Tara Schimpf
(74) *Attorney, Agent, or Firm* — Bracewell LLP; Constance R. Rhebergen

(57) ABSTRACT

A method of forming a wellbore with a drill string and that includes continuously and automatically measuring a TARE value of the drill string. The TARE value of the drill string is measured while the drill string is rotating, fluid is circulating in the drill string, and after the drill string has been axially stationary for a set period of time. The TARE value is designated as an average of the measured hook load over the latter half of the set period of time. Knowing the measured TARE value and a designated weight on bit ("WOB") of the drill string, a hook load for supporting the drill string is calculated. Matching the force applied that supports the drill string to the calculated hook load results in an actual WOB that matches the designated WOB.

16 Claims, 2 Drawing Sheets

(51) Int. Cl.
*E21B 10/00* (2006.01)
*E21B 41/00* (2006.01)

(56) References Cited

U.S. PATENT DOCUMENTS 7,044,238 B2 5/2006 Hutchinson
7,823,655 B2 11/2010 Boone
7,917,293 B2 3/2011 Newman
8,074,509 B2 12/2011 Bingham
8,417,495 B2 4/2013 Dashevskiy
8,473,435 B2 6/2013 Ringer
2009/0090555 A1 4/2009 Boone et al.
2011/0272195 A1 11/2011 Trinh
2014/0060931 A1* 3/2014 Pettapiece ..... E21B 44/00 175/27
2014/0190747 A1 7/2014 Hay
2014/0196949 A1* 7/2014 Hareland ..... E21B 44/00 175/27
2014/0231141 A1 8/2014 Hay
2015/0012253 A1* 1/2015 O'Donnell ..... G06F 17/5009 703/2
2015/0252664 A1* 9/2015 Astrid ..... E21B 44/04 700/275
2015/0361779 A1* 12/2015 Haq ..... E21B 44/00 702/9
2017/0370151 A1 12/2017 Banirazi-Motlagh et al.
2017/0370191 A1* 12/2017 Fox ..... E21B 44/00

FOREIGN PATENT DOCUMENTS

WO WO2013/002782 A1 1/2013
WO WO2014/055352 A1 4/2014
WO WO 2014/105034 A1 7/2014
WO WO2015/051027 A1 4/2015

* cited by examiner

WEIGHT ON BIT CALCULATIONS WITH AUTOMATIC CALIBRATION

BACKGROUND OF THE INVENTION

1. Field of Invention

The present disclosure relates to a method of calculating weight on bit for a drill string during earth boring operations. More specifically, the present disclosure concerns a method of calculating a tare weight, which is then used for estimating weight on bit.

2. Description of Prior Art

Hydrocarbon producing wellbores extend subsurface and intersect subterranean formations where hydrocarbons are trapped. Completing the wellbores with casing and tubing allows conduits for the hydrocarbons to be produced to surface. Earth boring drill bits are typically used to form the wellbores, which mount on ends of drill strings. Motorized drive systems on surface rotate the drill strings and bits, that in turn crush the rock. Cutting elements on the drill bit scrape the bottom of the wellbore as the bit is rotated and excavate material thereby deepening the wellbore. Drilling fluid is typically pumped down the drill string and directed from the drill bit into the wellbore. The drilling fluid flows back up the wellbore in an annulus between the drill string and walls of the wellbore.

The amount of weight or force applied to the drill bit during drilling, generally referred to as weight on bit ("WOB"), typically affects drilling performance and tool life. Applying an insufficient WOB often reduces penetration rate and increases bit vibration. In contrast, applying excessive WOB can cause mechanical bit failure; and above a certain maximum threshold WOB does not increase penetration rates further. The force exerted holding the drill string at the drilling rig is commonly referred to as the hook load. Traditionally, WOB measurements are based on a difference in hook load between bit off bottom and on bottom. That is, when a portion of the hanging drill string weight is supported by the bit resting on the bottom of the wellbore, hook load is reduced by that portion. This difference between current hook load and a pre-set "TARE" value is taken as a reference for the amount of weight put on the bit. A TARE value is typically obtained by measuring the hook load while suspending the drill string in the wellbore, and without the drill string being supported on the bottom. Because the drill string weight changes as drill pipe segments are added to the drill string, correctly applying a designated WOB requires that the TARE weight be constantly monitored.

SUMMARY OF THE INVENTION

Disclosed herein is an example of a method of forming a wellbore with a drilling assembly; where the drilling assembly is made up of a drill string with an attached drill bit. In this example, the method includes obtaining values of measured weights of the drilling assembly that were taken over a set time span, while the drilling assembly was rotating in the wellbore, while fluid was flowing through the drill string and was being discharged from nozzles that are on the drill bit, and while the drill string was axially stationary in the wellbore. The method of this example further includes estimating an average of the measured weight over a portion of the set time span, and designating a TARE weight of the drilling assembly to be substantially the same as the average of the measured weight over the set time span. The portion of the set time span can be about the latter half of the set time span. Alternatively, the portion of the set period of time can be about the entirety of the set time span. Optionally, the set time span can be about ten seconds. In this example, the portion of the set time span can be the latter 30 percent of the set time span. The fluid can flow in the drill string at a rate substantially equal to a maximum rate of flow in the drill string. The drill string can be axially stationary in the wellbore for a defined period of time before estimating an average of the measured weight. The method can further include repeating the steps of obtaining measured weights of the drilling assembly as it rotates, has fluid flowing therein, and while it is stationary; and re-estimating an average of the measured weight, and then designating a TARE weight based on an average of the measured weight over the set time span. The measured weight of the drilling assembly can be obtained while the drill bit was spaced away from a bottom of the wellbore. The method can further include measuring a hook load of the drilling string while the drill bit is in contact with a bottom of the wellbore, and subtracting the measured hook load from the TARE weight to obtain a measured weight on bit of the drilling assembly. In one example, the method further includes adjusting the hook load of the drilling string while the drill bit is in contact with the bottom of the wellbore until the measured weight on bit of the drilling assembly is substantially the same as a designated weight on bit of the drilling assembly.

Also disclosed herein is a method of forming a wellbore with a drilling assembly, where the drilling assembly is made up of a drill string with an attached drill bit. In this example the method includes obtaining values of the drilling assembly weights that were taken over a set time span and while the drilling assembly was rotating in the wellbore, while fluid was flowing through the drill string and was being discharged from nozzles that are on the drill bit, and while the drill string was axially stationary in the wellbore. The method of this example further includes calculating a TARE weight of the drilling assembly based on the values of the drilling assembly weights taken over the set time span. The step of calculating the TARE weight of the drilling assembly can involve taking an average of the values of the drilling assembly weights over a portion of the set time span. In this example the portion of the set time span is about the latter 50% of the set time span. The method may optionally further include estimating a weight on bit of the drilling assembly when the bit is in contact with a bottom of the wellbore, and adjusting a hook load supporting the drilling assembly based on the step of estimating a weight on bit, so that an actual weight on bit is substantially equal to a designated weight on bit. Further included with the method is repeating the steps of obtaining values of the drilling assembly weights and calculating a TARE weight of the drilling assembly after a length of pipe has been added to the drill string.

Another example method of forming a wellbore with a drilling assembly is disclosed herein, and where the drilling assembly has a drill string with an attached drill bit. In this example the method includes obtaining values of the weight of the drilling assembly that were measured over a time period while, the drilling assembly was rotating, fluid was flowing through the drilling assembly, and the drilling assembly was axially stationary, taking an average of the values of the weight of the drilling assembly that were measured during a time span that is about one half that of the time period to define an average weight, designating the average weight as a TARE weight of the drilling assembly, and estimating a weight on bit of the drilling using the TARE weight. The method can further include continuously monitoring drilling assembly rotation, fluid flow through the drilling assembly, and axial movement of the drilling assembly and repeating the steps of obtaining drilling assembly weight, taking the average of the values of the weight, and designating the average weight as a TARE weight; and the next time the drilling assembly is rotating, while fluid is flowing through the drilling assembly, and while the drilling assembly is axially stationary.

BRIEF DESCRIPTION OF DRAWINGS

Some of the features and benefits of the present invention having been stated, others will become apparent as the description proceeds when taken in conjunction with the accompanying drawings, in which.

Figure 1:
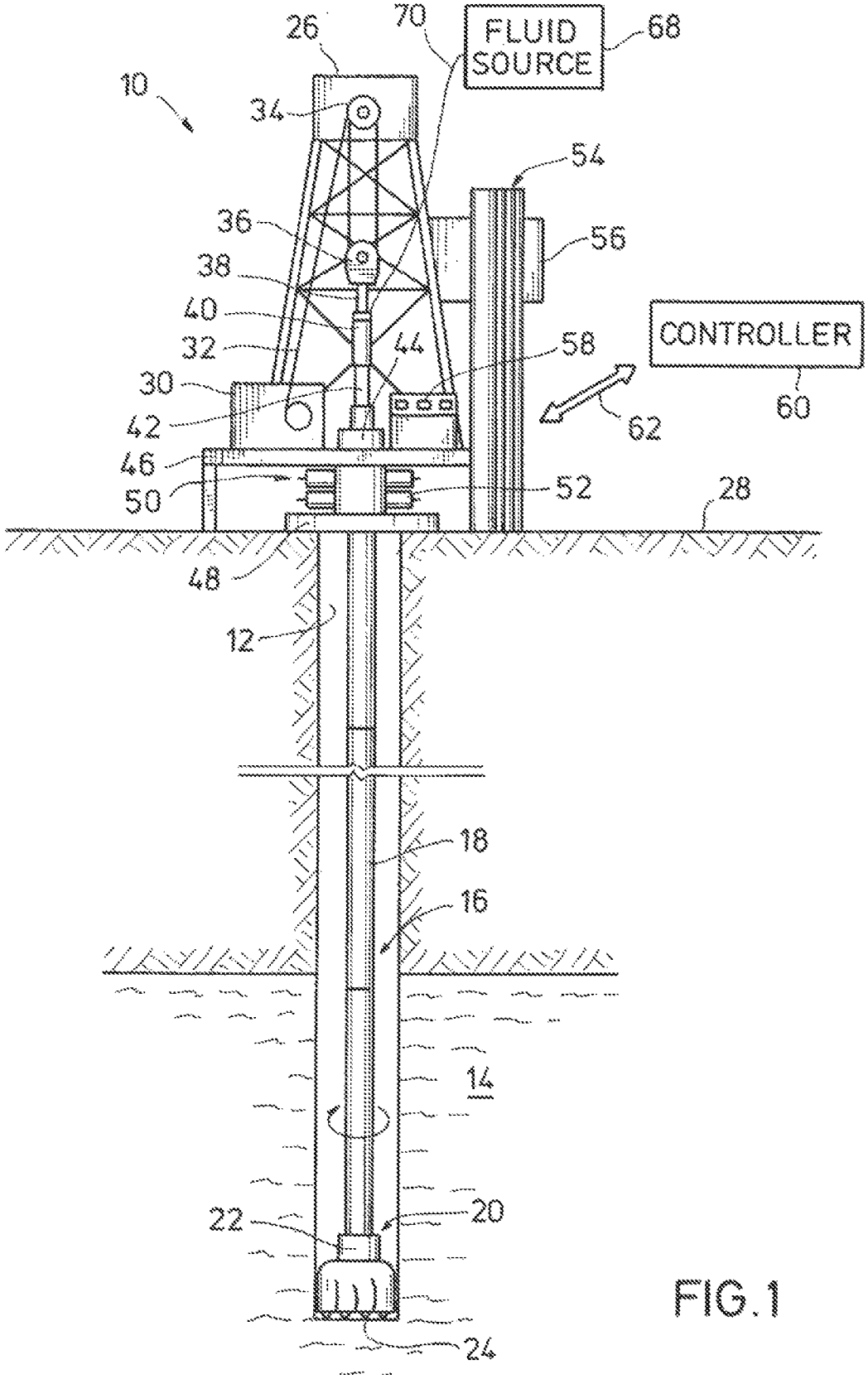
FIG. 1 is a side partial sectional view of an example of a drilling system having a drill string and forming a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

An example of a drilling system 10 is shown in a side sectional view in FIG. 1, where drilling system 10 is used for forming a wellbore 12 through a formation 14. Drilling system 10 includes an elongate drill siring 16 disposed within wellbore 12, and is shown made up of segments of drill pipe 18. In one example, the segments of drill pipe 18 are threadingly coupled to one another. A drill bit 20 is shown mounted on a lower end of drill string 16, and which includes a bit body 22 that threadingly mounts on a lowermost one of the drill pipes 18 of the drill string 16. Inserts or cutters 24 are shown on a surface of drill bit body 22 opposite from where it attaches to drill string 16. When the string 16 and bit 20 are rotated, the cutters 24 crush the rock making up the formation 14 thereby forming borehole 12.

Above an opening of wellbore 12 is a derrick 26 shown mounted on a surface 28, and which includes equipment for manipulating the drill string 16; which includes a drawworks 30. The drawworks 30 selectively pull or release a cable 32 shown engaging sheaves 34 that are rotatingly mounted on an upper end of derrick 26. Additional cables run through the sheaves 34, and which on a lower end support a traveling block 36, that in conjunction with a hook 38 and swivel 40 couple with drill string 16 for raising and lowering drill string 16. A kelly 42 axially couples to a lower end of swivel 40; and is rotatable with respect to swivel 40. A lower end of kelly 42 projects through a rotary table 44, which engages outer surfaces of kelly 42 and rotates to exert a rotational force onto drill string 16. Rotary table 44 is formed on a platform 46 that attaches to derrick 26, and is set above surface 28. Drawworks 30 are shown mounted on platform 46. Below platform 46 and at surface 28 is a wellhead housing 48 that is mounted in the opening of wellbore 12. On top of the wellhead housing 48 is a blowout preventer ("BOP") 50 and through which segments of the drill pipe 18 are inserted after being coupled with kelly 42. Rams 52 mount on lateral sides of BOP 50 and are equipped with blades (not shown) that can selectively sever the pipe string 16 and also form a safety barrier in the event wellbore 12 needs to be shut-in during emergency situations.

Further shown on surface 28 are stands of pipe 54 that are supported by a rack 56 illustrated on one of the side beams of derrick 26. Also on platform 46 is a driller's console 58 having gauges representing downhole conditions, and controls for operating the drilling assembly 10; such as the drawworks 30. Schematically illustrated is a controller 60 having a communication means 62 to provide communication between controller 60 and console 58. Communications means 62 can be wireless, fiber optic, or made up of electrically conducting material. Embodiments exist wherein controller 60 is included within console 58.

The weight on bit ("WOB") exerted by drill string 16 on the bottom of wellbore 12 can be controlled by an operator on the platform 46 and in conjunction with the console 58. Operator can adjust drawworks 30 so that an upward force on drill string 16 can be exerted on traveling block 36, hook 38, swivel 40, and kelly 42. Alternatively, these functions can be from software commands stored in a medium that operates in conjunction with the controller 60. In one example, WOB is estimated based on a hook load, which is the axial force exerted on hook 38, or other components that provide an axial supporting force for drill string 16. Sensors (not shown) can provide a signal that when viewed at console 58 represents the axial load by which drill string 16 is supported by the remaining portions of the drilling system 10, i.e. the hook load.

Figure 2:
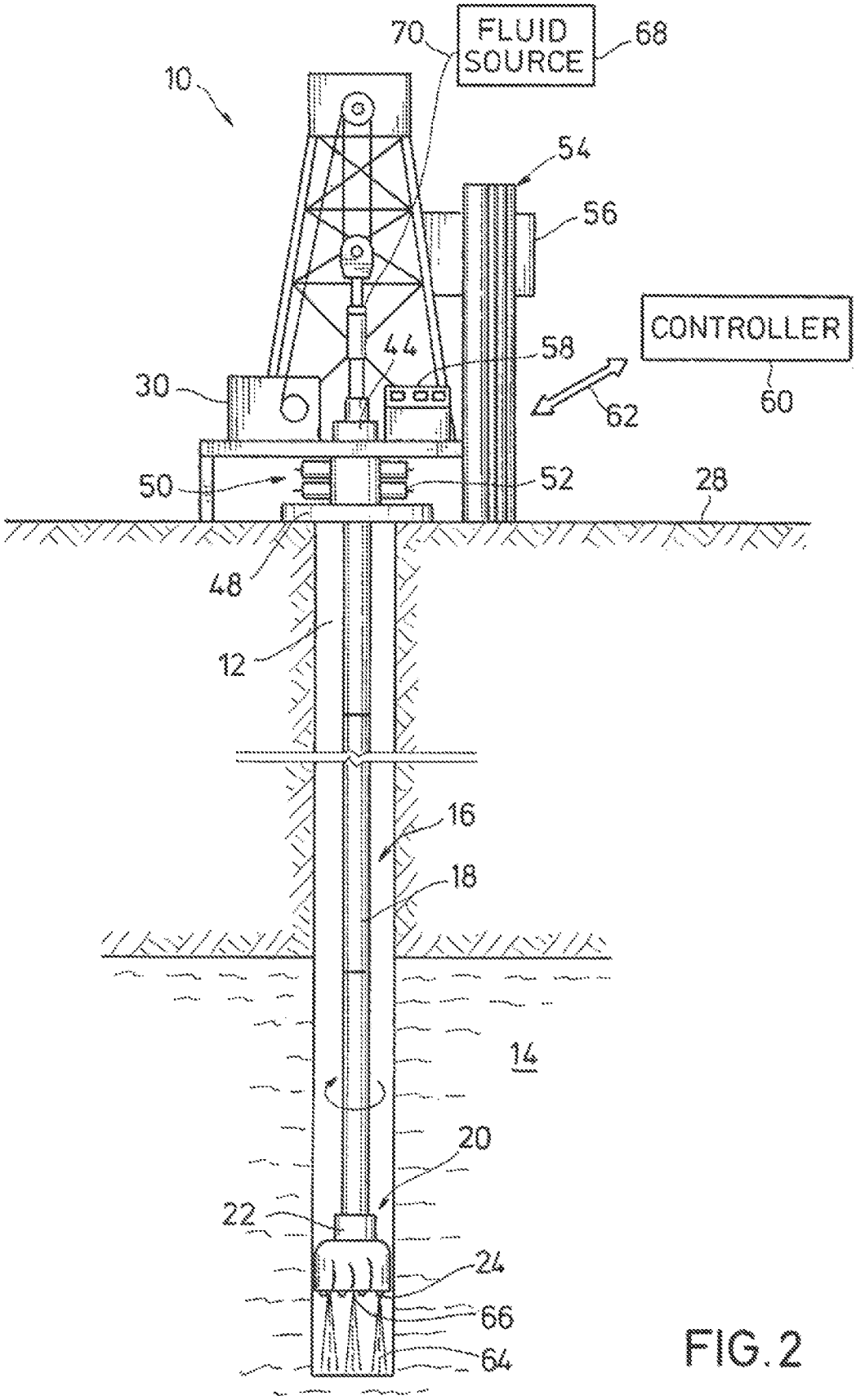
FIG. 2 is a side partial sectional view of at example of the drilling system of FIG. 1 while the TARE weight of the drill string is being measured.

Referring now to FIG. 2, shown in side partial sectional view is an example of estimating a TARE weight of the drill string 16. In this example, drill string 16 and bit 20 are drawn upwards within wellbore 12, such as by actuation of drill works 30 so that drill bit 22 is raised up from the bottom of wellbore 12. Here the TARE weight is measured after following conditions have occurred: (1) the drill string is rotating, which eliminates stored static axial friction forces that can absorb some of the total drill string weight; (2) mud or other drilling fluid is circulating through an annulus within drill string 16 and shown being discharged as fluid jets 6 that exit from nozzle 66 formed on a lower end of drill bit and adjacent the cutters 24; and (3) the drilling system detects no axial movement of the drill string 16 for a defined period of time. The lack of axial movement ensures that static or dynamic friction forces are no longer exerted on the drill string 16. The fluid that forms the fluid jet 64 can be from a fluid source 68 shown on surface and that connects into swivel 40 via fluid line 70. Moreover, the TARE weight is in one example taken to be an average of the values of the measured weight of the drill string 16 taken over a set time period. In one example the set time period is about 10 seconds; in this example, the TARE weight is taken to be the average of the values of measured weight of the drill string 16 taken over the about 10 second time span. In another embodiment the TARE weight is taken to be the average of the measured weight of the drill string 16 taken over a portion of the set time period, where the portion can be substantially the same as the set time period, or any amount of time that is less than the set time period. Embodiments exist wherein the portion ranges from 1% to 99% of the set time period, 10% to 90% of the set time period, 20%-80% of the set time period, 30%-70% of the set time period, 40%-60% of the set time period, 50% of the set time period, any discrete value within these percentage values, and combination of the upper and lower limits provided herein, e.g. 30%-50%. The percentage portions of the set time period can be weighted towards the beginning of the set time period, the middle of the set time period, or the end of the set time period. In a specific example, where the set time period is about 10 seconds, the average hook load measured during the last 3-5 seconds of this time period is used for the TARE weight.

Each time a TARE weight is calculated, a weight on bit value can be calculated by subtracting the hook load daring drilling from the TARE weight. In one embodiment, a TARE weight is measured every time a segment of drill pipe 18 is added to the drill string 16. Moreover, examples exist where the controller 60 can be programmed to automatically obtain values of TARE weights when the three above-mentioned conditions are met ((1) the drill string is rotating; (2) fluid flow through the drill string; and (3) no axial movement of the drill string) so that not only can an accurate TARE weight be obtained, but will also accommodate situations where lengths of pipe 18 are added to pipe string 16, thereby increasing the weight of the drill string 16 and affecting the TARE weight. Moreover, obtaining TARE weights as described herein automatically and at regular intervals can ensure an accurate TARE weight is being used.

Although the drilling system shown includes a derrick 26 and kelly system, other types of drilling systems can be employed with method, such as a top drive system. Moreover, the knowledge of a designated weight on bit is important so that when the new TARE weight is obtained, adjusting the hook load can then result in a true weight on bit that is substantially the same as the designated weight on bit. As such, desired drilling rates can be obtained and without undue wear being imparted on the drill bit 20. Alternate examples exist wherein the TARE weight is taken to be an average of the entire time span, half of the time span, or about 30% of the time span. Moreover, the latter portion of the time span can be used in order to obtain the estimated averages.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of forming a wellbore with a drilling assembly that comprises a drill string with an attached drill bit, the method comprising:

a. weighing the drilling assembly when each of the following are occurring concurrently,
   i. the drilling assembly is rotating in the wellbore,
   ii. fluid is flowing through the drill string and exiting from nozzles that are on the drill bit, and
   iii. the drill string is axially stationary in the wellbore;
b. designating a TARE weight of the drilling assembly to be substantially the same as the measured weight; and
c. identifying a designated weight on bit that is based on a weight on bit at which a desired drilling rate is obtained and without undue wear being imparted on the drill bit; and
d. adjusting a true weight on bit to be substantially the same as the designated weight on bit by changing a hook load applied to the drill string based on the step of designating the TARE weight.

2. The method of claim 1, wherein weighing the drilling assembly comprises observing weights of the drilling assembly within a set time span, and wherein the measured weight is based on an average of the weights of the drilling assembly observed during a portion of the set time span.

3. The method of claim 1, further comprising continuously monitoring the drill string rotation, for fluid flowing through the drill string, and that there has been no axial movement of the drill string for a defined period of time.

4. The method of claim 2, wherein the portion of the set time span comprises the latter 30 percent of the set time span.

5. The method of claim 1, wherein the fluid flows in the drill string at a rate substantially equal to a maximum rate of flow in the drill string.

6. The method of claim 2, wherein the drill string is axially stationary in the wellbore for a defined period of time before the weights of the drilling assembly are observed.

7. The method of claim 2, wherein the portion of the set time span is about the latter half of the set time span.

8. The method of claim 1, further comprising measuring a hook load of the drilling string while the drill bit is in contact with a bottom of the wellbore, and subtracting the measured hook load from the TARE weight to obtain a measured weight on bit of the drilling assembly.

9. The method of claim 8, further comprising adjusting the hook load of the drilling string while the drill bit is in contact with the bottom of the wellbore until the measured weight on bit of the drilling assembly is substantially the same as a designated weight on bit of the drilling assembly.

10. A method of forming a wellbore with a drilling assembly that comprises a drill string with an attached drill bit, the method comprising:

obtaining weight values of the drilling assembly by weighing the drilling assembly over a set time span during which the following are concurrently occurring, (i) the drilling assembly is rotating in the wellbore, (ii) fluid is flowing through and exiting the drill string, and (iii) the drill string is axially stationary in the wellbore;

recording the weight values;

calculating a TARE weight of the drilling assembly based on the recorded weight values;

identifying a designated weight on bit of the drilling assembly at which a desired drilling rate is obtained and without undue wear being imparted onto the drill bit; and adjusting a drilling parameter based on the calculated TARE weight so that a true weight on bit of the drilling assembly is substantially the same as the designated weight on bit.

11. The method of claim 10, wherein the step of weighing the drilling assembly comprises supporting the drilling assembly in the wellbore with an axial force and sensing values of the axial force.

12. The method of claim 11, wherein the portion of the set time span is about the latter 50% of the set time span.

13. The method of claim 10, further comprising estimating a weight on bit of the drilling assembly when the bit is in contact with a bottom of the wellbore, and adjusting a hook load supporting the drilling assembly based on the step of estimating a weight on bit, so that an actual weight on bit is substantially equal to a designated weight on bit.

14. The method of claim 10, further comprising repeating the steps of obtaining, and calculating a TARE weight of the drilling assembly each time after a length of pipe has been added to the drill string.

15. A method of forming a wellbore with a drilling assembly that comprises a drill string with an attached drill bit, the method comprising:

measuring values of the weight of the drilling assembly over a time period while the drilling assembly was rotating concurrent with fluid flowing through the drilling assembly and concurrent with the drilling assembly being axially stationary;

calculating an average of the values of the weight of the drilling assembly that were measured during a time span that is about one half that of the time period to define an average value of the weight of the drilling assembly;

designating the average value of the weight of the drilling assembly as a value of a TARE weight of the drilling assembly;

estimating a value of a weight on bit of the drilling assembly using the value of the TARE weight to define an estimated value of a weight on bit;

identifying a designated weight on bit of the drilling assembly at which a desired drilling rate is obtained and without undue wear being imparted onto the drill bit; and adjusting a hook load applied to the drilling assembly so that an actual weight on bit is substantially the same as the designated weight on bit.

16. The method of claim 15, further comprising continuously monitoring drilling assembly rotation, fluid flow through the drilling assembly, and axial movement of the drilling assembly and repeating the steps of obtaining, calculating, designating, estimating, and adjusting.

* * * * *